United States Patent [19]

Lee

[11] Patent Number: 4,566,366

[45] Date of Patent: Jan. 28, 1986

[54] HAND HELD CARTRIDGE RELOADING PRESS

[76] Inventor: Richard J. Lee, 3146 Kettle Moraine, Hartford, Wis. 53027

[21] Appl. No.: 648,307

[22] Filed: Sep. 7, 1984

[51] Int. Cl.[4] ..... F42B 33/10; F42B 33/04

[52] U.S. Cl. ..... 86/24; 86/28; 86/37; 86/40

[58] Field of Search ..... 86/23, 24, 28, 33, 37, 86/38, 40, 25

[56] References Cited

U.S. PATENT DOCUMENTS

| | | | |
|---|---|---|---|
| 361,966 | 4/1887 | Morse | 86/24 |
| 1,864,880 | 6/1932 | Zimmerman | 86/37 |
| 2,550,973 | 5/1951 | Corcoran | 86/24 |
| 3,049,044 | 8/1962 | English | 86/24 |
| 3,555,959 | 1/1971 | Lee | 86/24 |
| 3,603,199 | 9/1971 | Corcoran | 86/24 |
| 3,735,666 | 5/1973 | Decker | 86/24 |
| 4,142,441 | 3/1979 | Schaenzer | 86/37 |
| 4,325,282 | 4/1982 | Schaenzer | 86/24 |

*Primary Examiner*—Stephen J. Lechert, Jr.
*Assistant Examiner*—Howard J. Locker
*Attorney, Agent, or Firm*—Fuller, House & Hohenfeldt

[57] ABSTRACT

A hand held cartridge case reloader has a first elongated handle body on which there are spaced apart laterally extending members. The upper member is threaded to receive standard cartridge reloading tools. The lower member is bored to receive a reciprocable ram for holding a cartridge case at its upper end. A second handle body has a pivotal connection to the lower end of the ram and another pivotal connection to the lower end of a link whose upper end is pivotally connected to the lower end of the first handle body adjacent the ram.

1 Claim, 5 Drawing Figures

HAND HELD CARTRIDGE RELOADING PRESS

BACKGROUND OF THE INVENTION

This invention pertains to a hand held cartridge case reloading press.

The new press is portable and does not need to be fastened to a stable object, such as a bench, to use it. Thus a hunter or target shooter can take his or her reloading press any place it is convenient to carry a rifle. There has been a long felt need for a light weight, low complexity and relatively inexpensive portable cartridge reloading tool. Attempts to develop one go back at least as far as the year of 1871 when U.S. Pat. No. 118,849 issued. One of the more recently developed hand held reloading tools is described in U.S. Pat. No. 3,049,044. The tool in this patent comprises a tubular member and a ram that is reciprocable in the member. A compound lever system drives the ram. The tubular member has a side opening for inserting a cartridge on which a reloading operation is to be performed. Specially shaped adapters and dies are screwed on to the end of the ram for performing the successive reloading operations on each cartridge case. The user is compelled to hold the tubular member with one hand and operate the single lever with the other hand which means that it is possible to squeeze the fingers between the lever and the tubular member.

One of the disadvantages of prior art portable reloading tools is that they require specialized dies and cannot use readily available dies which are standard for use in bench mounted reloading presses. Another disadvantage is that they use many different parts for the various reloading operations such as primer removal and insertion, cartridge case shaping, and bullet insertion. Insofar as applicant is aware, no one has produced a hand held cartridge reloading press that is suitable for full length sizing of a cartridge and is yet economical to produce and easy to use.

SUMMARY OF THE INVENTION

An objective of the present invention is to provide a hand held press in which standard commercially available dies for performing the various reloading operation can be used.

Another objective of the invention is to provide a light weight, but strong hand held press wherein two handle bodies can be forced toward each other with opposite hands with little risk to the user of getting his fingers between the operating handles.

An important feature of the invention is that a compound lever system which drives the ram is so arranged as to enable obtaining a high mechanical advantage so that adequate force can be developed for re-sizing the entire length of a cartridge case and yet limiting the advantage so the press can not be damaged by development of excessive force.

Briefly stated, the new hand held cartridge case reloading press comprises a first elongated handle body having nominally upper end lower ends. The body has a first member extending laterally at its lower end and a second member extending laterally intermediate of the first member and the upper end of the handle body. The first and second laterally extending members have coaxial bores. A ram reciprocates in the bore of the first member toward and away from the second member in response to forcing the handle bodies toward and away from each other, respectively. The bore of the second laterally extending member has an internal thread into which any of the standard reloading press dies may be inserted. For instance, a tool for depriming and re-sizing the cartridge case or a tool for seating and crimping a bullet in the neck of the cartridge case can be inserted. Thus, a batch of spent cartridges can be deprimed, resized, primed and have a bullet inserted, in that order.

How the foregoing and other objectives of the invention are achieved will be evident in the ensuing more detailed description of a preferred embodiment of the invention which will now be set forth in reference to the drawings.

DESCRIPTION OF A PREFERRED EMBODIMENT

Figure 1:
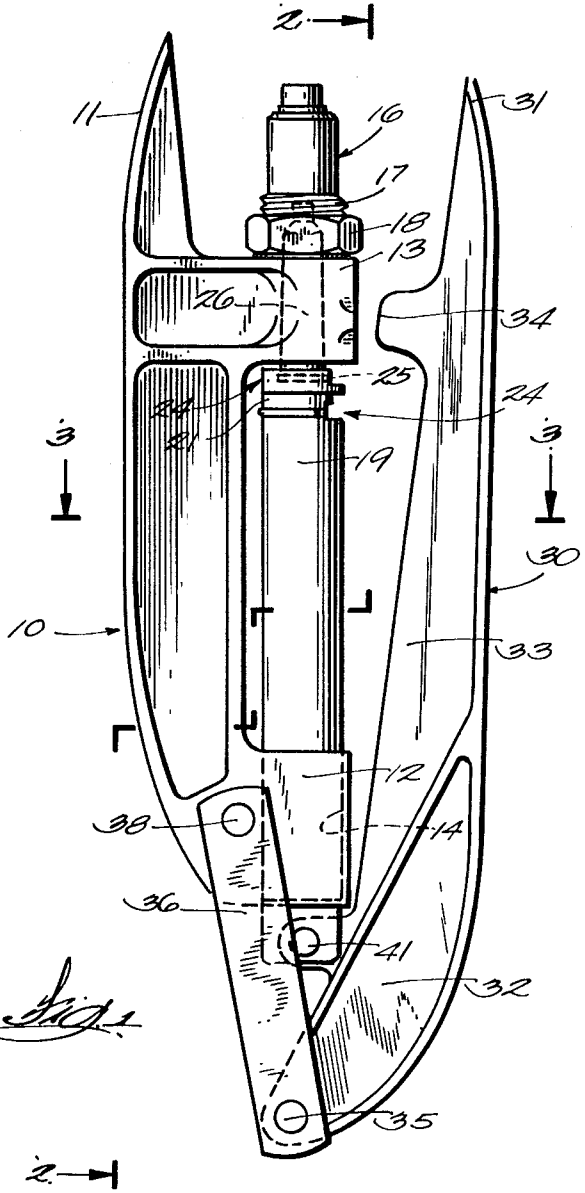
FIG. 1 is a front elevation view of the new hand held cartridge case reloading press which has a die installed and shows the ram driven to its upper limit for forcing a cartridge case into the die.

Referring to FIG. 1, the press comprises a first handle body generally designated by the numeral 10. The upper end 11 is curved to make it more comfortable for the user when his or her hand is used to press against the handle. Handle body 10 has a laterally extending member 12 at its nominally lower end and another laterally extending member 13 near its nominally upper end. The terms "upper" and "lower" are used to orientate the reader to the drawings, but it will be understood that the press may be held in various attitudes when in use. Lower laterally extending member 12 has a smooth internal bore 14 which is juxtaposed to first handle body 10. The upper laterally extending member 13 has a bore containing a female thread 15. A typical reloading tool or die 16 having a male thread 17 is shown screwed into female thread 15 in laterally extending member 13. The die is secured against rotating or changing its setting with a lock nut 18. The pitch and diameter of the thread 17 on the die is quite standardized in the industry. For instance, standard dies have a diameter of $\frac{7}{8}$ inch and 14 threads per inch. Dies having standard specifications can be obtained from any one of several reloading press accessory manufacturers.

There is a cylindrical axially reciprocable ram 19 inserted through the bore 14 in the lower laterally extending member 12. The upper end 14 of the ram has a laterally extending slot 20 milled into it as can be seen most clearly in FIG. 4. The slot does not extend all of the way across the ram diameter so as to leave a wall 21 remain. This wall then has an overhanging lip 22 which defines a channel for receiving the complementarily shaped lower end 23 of a shell holder 24. The shell holder is also a standard part commonly used in commercially available bench mounted reloading presses.

Figure 4:
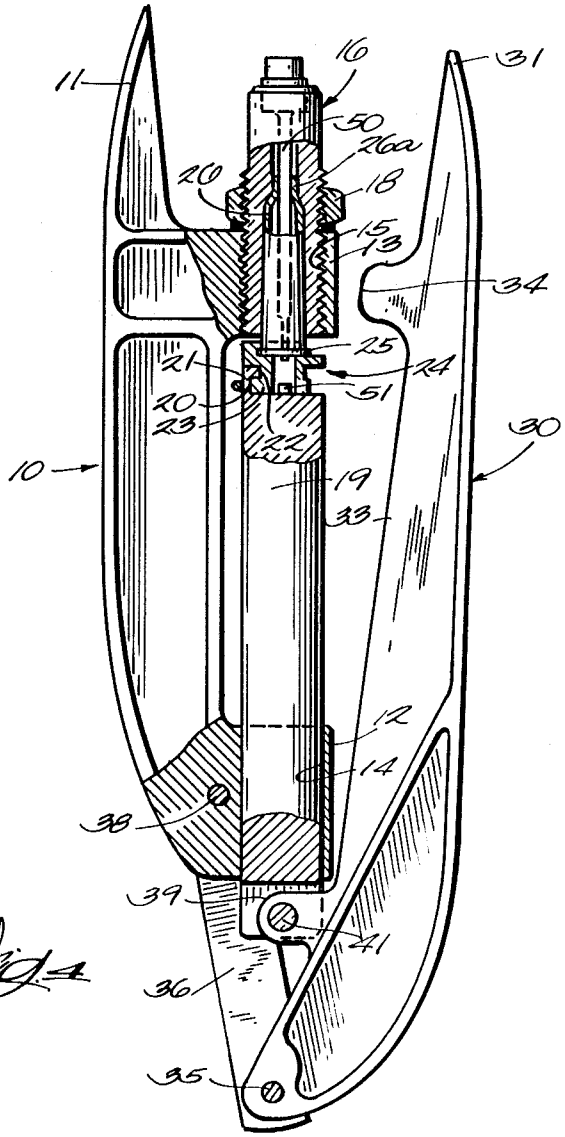
FIG. 4 is similar to FIG. 1 except that is shows the details of a die that is adapted for depriming a cartridge case and, in the same operation re-sizing the neck and the length of the case.

As can be seen in FIGS. 1 and 4, the shell holder 24 also has a lateral slot for receiving the head or rim end 25 of a cartridge case 26.

Figure 3:
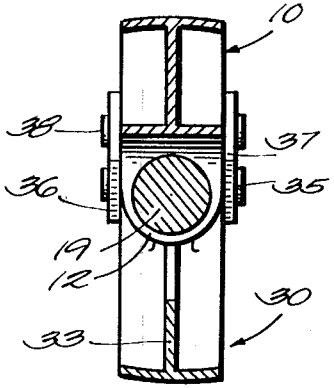
FIG. 3 is a transverse section taken on a line corresponding to 3—3 in FIG. 1.
Figure 2:
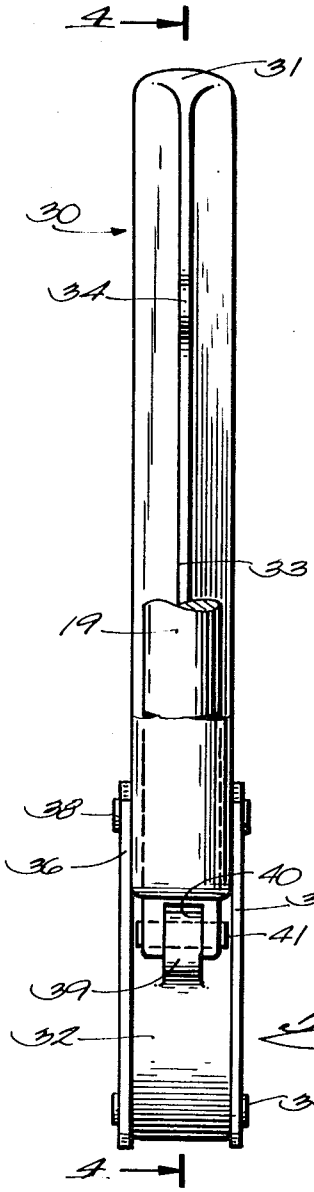
FIG. 2 is an irregular section taken on the line corresponding to 2—2 in FIG. 1.

The press has a second elongated handle body constituting a lever, that is generally designated by the numeral 30. Its upper end 31 is curved similarily to upper end 11 on first handle body 10. As can be seen in FIG. 3, the upper ends 11 and 31 of the handle bodies are curved transversely to the length of the bodies as well as along the length of the handle bodies. The curvature makes it more comfortable to the user when the palms of the opposite hands are placed on the curved portions to press or squeeze the handles toward each other to drive the ram axially during performance of the reloading steps. As can be seen in FIG. 2 particularly well, the lower end 32 of second handle body 30 has the full width of the outside handle body and there is a stiffening web 33 running from the lower end 32 to the upper end 31 of handle body 30. The stiffening web has a projection 34 which can abut against the outside of the upper laterally extending member 13 on handle body 10 to limit travel of one handle toward the other when they are being squeezed together for having a die act on a cartridge. The sides of lower end 32 of handle body 30 are flat. At the lower extremity of this flat sided portion, the handle body is provided with a transverse hole which is occupied by a headed pivot pin 35. There is a pair of links 36 and 37 whose lower ends are pivotally connected to the lower end of handle body 30 by means of pin 35. The other ends of links 36 and 37 are pivotally connected by means of a headed pin 38 which extends through handle body 10 adjacent a bore 14 in laterally extending member 12 through which the ram 19 reciprocates. Pivot pin 38 is offset, that is, it is to the side of ram 19 instead of being aligned with the ram as has been the prior practice. One advantage of this is that pin 38 can pass through the solid laterally extending member and also provide double shear strength relative to links 36 and 37. Handle body 30 has a projection or tongue 39 integral with it. The width of the tongue, as can be seen in FIG. 2, complements the width of a diametral slot 40 that is formed in the lowermost end of ram 19. The tongue is pivotally connected to ram 19 by means of a headed pin 41. Links 36, 37 and the pivotally connected handle body 30 constitute a compound lever system for forcing ram 19 toward the die 16 as in FIGS. 1 and 4 and retracting the ram away from the dies to permit exchanging cartridge cases in shell holder 24.

Figure 5:
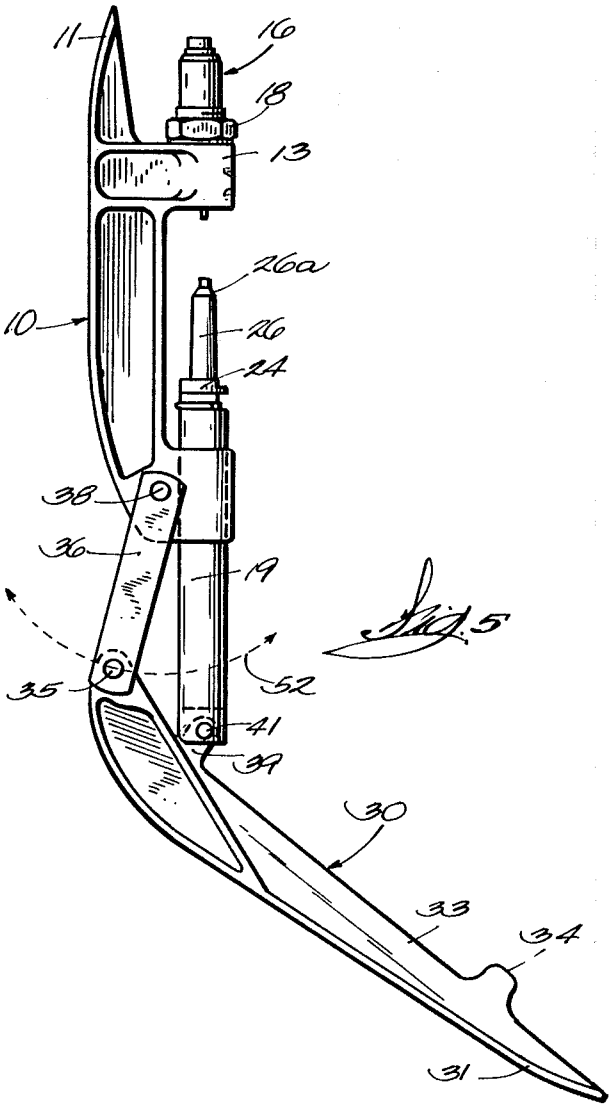
FIG. 5 shows the press with one of its operating handles swung to one limiting position wherein the ram is retracted for permitting a cartridge case to be inserted on a shell holder at the upper end of the ram.

In FIG. 5, handle body 30 is swung down to its lowermost position for retracting ram 19 to its lowermost position. After a cartridge case 26 is inserted in shell holder 24, the hands of the user are placed on the handle bodies 10 and 30 in the curved regions marked 11 and 31 and the user swings and squeezes the handle bodies 30 and 10 toward each other to finally reach the position in which the handle bodies are shown in FIGS. 1 and 4. Then, with the palms of the hands applied to curved portions 11 and 21 of the handle bodies the handles are finally forced toward each other until the stop or projection 34 on body 30 abuts the outside wall of the upper laterally extending member 13.

Performance of one of the cartridge reloading steps is demonstrated in FIG. 4. Here the cartridge case 26 is forced into the bore of die 16 internally dimensioned and shaped for re-sizing the length of the cartridge and the outside diameter of the bullet receiving neck **26*a* as well. As the cartridge is driven by the ram to the position to which it is shown in FIG. 4, the rim end 25 of the case was driven against the reduced diameter lower tip of a spent primer removing rod 50 which is anchored in die 16. Spent primer 51 is thereby driven out and captured in a central bore within shell holder 24. When the ram is retracted, of course, the spent primer can be spilled out of the bore. After a batch of casings have been re-sized and had their primers removed, die 26** can be exchanged for a die that is designed for inserting new primers and powder in the case. Finally, a die for pressing a bullet into the case and crimping it around the neck can be substituted in the press.

It should be noted that when the operating handle 30 is raised from its FIG. 5 position, the ram 19 rises which makes it possible to squeeze the two handle bodies together. This is possible because of the location of the pivot points of the compound lever system constituted by handle body 30 and the links 36 and 37.

Referring to FIG. 5, one may see that pivot pin 35 swings along the arc indicated by the dashed line marked 52. Since ram 19 is guided in laterally extending member 12 for moving linearly only, pivot pin 35 must swing, because the distance between the connection made to the links by pivot pin 35 and the connection made to the ram by pivot pin 41 is rigid and fixed. When the handle body 30 is near the end of its travel as in FIG. 1 and 4, the lower end of links 36 and 37, that is, pivot point 35, passes the center line of the ram in which case a toggle near dead center action occurs where maximum force is developed for re-sizing a cartridge. In addition to the reason stated earlier for having pivot pin 38 offset or out of alignment with ram 19, another reason is to avoid having the axes of pins 38, 35 and 41 ever align with the center line of the ram. This limits the maximum mechanical advantage and assures that the parts will not be overstressed. In a commercial embodiment of the press, the mechanical advantage is limited to 30:1.

Although preferred embodiment of the invention has been described in detail, such description is intended to be illustrative rather than limiting, for the invention may be variously embodied and is to be limited only by interpretation of the claims which follow.

I claim:

1. A hand held cartridge case reloading press comprising:

a first elongated handle body having nominally upper and lower ends, said body having a first laterally extending member at its lower end and a second laterally extending member intermediate of said first member and said upper end, said second member having a bore containing a female thread for receiving a mating male thread $\frac{7}{8}$ of an inch in diameter and 14 threads per inch on a standard die element for performing operations on a cartridge case, said first member having a bore coaxial with the bore in said second member whose axis is juxtaposed to said first handle body, a reciprocable ram extending through the bore in said first laterally extending member, said ram having means at an end above said first member to retain a shell holder and having a lower end below said first laterally extending member;

a second elongated handle body having nominally upper and lower ends and means pivotally connecting said second elongated handle body to said lower end of the ram at a place on said handle body spaced from its lower end, link means having a first pivotal connection to the lower end of said first handle body offset laterally from said ram and a second pivotal connection to the lower end of said second handle body such that said second handle body pivots on said second pivotal connection for permitting said handle bodies to be swung toward and away from each other to thereby reciprocate said ram, and a stop element projecting from said second handle body for striking said second laterally extending member to thereby limit the swing of one handle body toward the other so that a safe mechanical advantage can not be exceeded.

* * * * *